US011426011B2

(12) United States Patent
Ogilvie

(10) Patent No.: US 11,426,011 B2
(45) Date of Patent: Aug. 30, 2022

(54) DEVICES AND METHODS USING BALLAST FILLED WATER BOTTLE FOR AIDED MOTOR SKILL DEVELOPMENT

(71) Applicant: One Eyed Jack Holdings Inc., Winnipeg (CA)

(72) Inventor: Daniel R. Ogilvie, Winnipeg (CA)

(73) Assignee: One Eyed Jack Holdings Inc., Winnipeg (CA)

( * ) Notice: Subject to any disclaimer, the term of this patent is extended or adjusted under 35 U.S.C. 154(b) by 291 days.

(21) Appl. No.: 16/869,852

(22) Filed: May 8, 2020

(65) Prior Publication Data

US 2020/0359808 A1 Nov. 19, 2020

Related U.S. Application Data

(60) Provisional application No. 62/848,832, filed on May 16, 2019.

(51) Int. Cl.
*A47D 13/04* (2006.01)
*B65D 81/36* (2006.01)

(52) U.S. Cl.
CPC ..... *A47D 13/04* (2013.01); *B65D 81/365* (2013.01)

(58) Field of Classification Search
CPC ..... A47D 13/04; B65D 81/365
USPC ..... 434/255, 258; 150/154; 206/457
See application file for complete search history.

(56) References Cited

U.S. PATENT DOCUMENTS

| | | | | |
|---|---|---|---|---|
| 4,514,995 | A * | 5/1985 | Curtis | D04B 1/22 66/200 |
| 4,526,280 | A * | 7/1985 | Taylor | B65D 77/0406 D3/202 |
| 6,237,787 | B1 * | 5/2001 | Gallo | B65D 81/365 222/105 |
| 7,182,351 | B2 * | 2/2007 | Williams | A47D 13/04 280/32.6 |
| 2016/0083137 | A1 * | 3/2016 | Serras | B65B 3/04 206/457 |

* cited by examiner

*Primary Examiner* — Jacob K Ackun
(74) *Attorney, Agent, or Firm* — Kyle R Satterthwaite; Ryan W Dupuis; Ade & Company Inc.

(57) ABSTRACT

For development of a baby's gross motor skills, a stand-up training aid is used in combination with a water cooler bottle. The aid features a shroud sized and shaped to fit over the water cooler bottle, and one or more accompanying features, selected from among: a mat that is attached or attachable to the shroud to surround the water cooler bottle in a lain position atop to the floor or ground to use the baby's own body weight to anchor the shroud in place, a plurality climbing elements attached to an exterior of the shroud for manual gripping by the baby, ornamental and/or interactive elements attached at or near an upper end of the shroud to attract attention of the baby toward elevated locations, connection elements attached at or near the upper end of the shroud to accept selective coupling of toys or accessories for such elevational attraction purposes.

19 Claims, 6 Drawing Sheets

DEVICES AND METHODS USING BALLAST FILLED WATER BOTTLE FOR AIDED MOTOR SKILL DEVELOPMENT

CROSS-REFERENCE TO RELATED APPLICATIONS

This application claims benefit under 35 U.S.C. 119(e) of U.S. Provisional Patent Application No. 62/848,832, filed May 16, 2019, the entirety of which is incorporated herein by reference.

FIELD OF THE INVENTION

The present invention relates generally to devices and techniques for aiding motor skill development in babies, and more particularly to baby stand-up aids for development of gross motor skills.

BACKGROUND

Devices used to aid or encourage a baby's development of gross motor skills (standing, balancing, walking) are conventionally focussed on development of walking skills, and tend not to focus on earlier development of basic standing skills. CN103230183 is one of a number of applications by Ningbo Zhenhai Ximen Patent Technology Development Co., Ltd. for a standing aid featuring a top-padded wooden base plate atop which an externally padded steel is erected, on which there are carried graspable elements by which a baby can pull themself upward into an erect standing position, and learn to balance as they prepare to take their first steps. However, the devices are relatively bulky, thus either being space intensive for transport or storage, or requiring assembly or disassembly of multiple components to transition between an erected ready state, and a collapsed storage or transport state.

Accordingly, there remains a need for improved solutions for helping development of a child's gross motor skills.

SUMMARY OF THE INVENTION

According to one aspect of the invention, there is provided, for use by a baby during development of gross motor skills, a stand-up training aid useful in combination with a water cooler bottle having a lower main body of generally cylindrical shape, an upper neck of lesser diameter that said main lower body, and an intermediate shoulder section tapering upwardly and inwardly from said lower main body to said upper neck, said baby stand-up training aid comprising:

a bottle cover comprising:

a shroud sized and shaped to fit over said water cooler bottle in an installed position spanning circumferentially around the lower main body of the water cooler bottle, and in overlying relation to the intermediate shoulder section of the water cooler bottle around the upper neck thereof; and any one or more of the following:

a mat attached or attachable to the shroud at a lower end thereof and emanating outwardly therefrom in order surround the water cooler bottle in a lain position atop a ground or floor surface when the lower main body of the water cooler bottle is seated on said ground or floor surface;

a plurality climbing elements attached to an exterior of the shroud that faces outwardly away from the water cooler bottle in the installed position to enable manual gripping of said climbing elements by said baby, said climbing elements being distributed circumferentially around the shroud on all sides thereof and distributed at multiple elevations on said shroud on each of said sides thereof;

ornamental and/or interactive elements attached to the shroud at or proximate an upper end thereof to reside at or proximate an upper end of the water cooler bottle in the working position of the shroud to attract attention of the baby toward elevated locations on or above the water cooler bottle; and connection elements attached to the shroud at or proximate an upper end thereof to accept selective coupling of toys or accessories to the shroud to attract attention of the baby toward elevated locations on or above the water cooler bottle.

According to another aspect of the invention, there is provided a method of aiding development of a baby's gross motor skills, said method comprising using a ballast-filled water cooler bottle seated on a ground or floor surface as a weighted object against which the baby can lean and climb into a standing position.

BRIEF DESCRIPTION OF THE DRAWINGS

Preferred embodiments of the invention will now be described in conjunction with the accompanying drawings in which.

DETAILED DESCRIPTION

Figure 1:
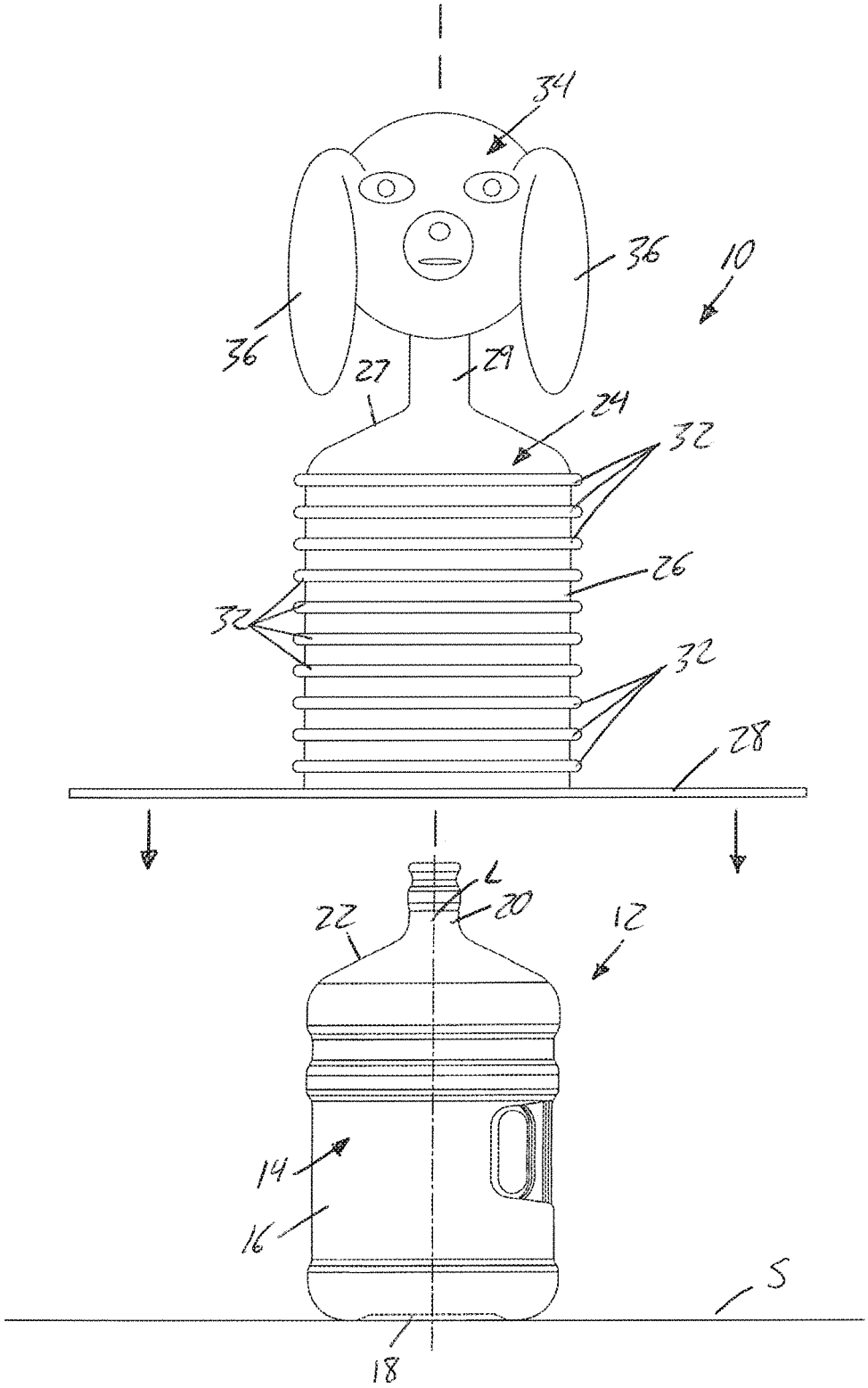
FIG. 1 is an exploded elevational view of a first embodiment water bottle cover placeable over a water cooler bottle to serve as a baby stand-up training aid that a baby can use to pull themself up into, and balance in, a standing position during early development of gross motor skills.

FIG. 1 illustrates of a water bottle cover 10 according to a first embodiment of the present invention. The water bottle cover 10' is placeable over a conventional 5-gallon water cooler bottle 12 to serve as a baby stand-up training aid that a baby can use to pull themself up into, and balance in, a standing position, thus contributing to their development of gross motor skills. In conventional fashion, the water cooler bottle 12 features a lower main body 14 having a peripheral wall 16 of generally cylindrical shape spanning concentrically and circumferentially around a central longitudinal axis L of the bottle 12, and a base 18 that closes off the lower main body at the bottom end thereof. The bottle also includes an upper neck 20 of generally cylindrical shape that likewise spans concentrically and circumferentially around the central longitudinal axis 16, but is of notably lesser diameter than the peripheral wall of the lower main body 14. An intermediate shoulder 22 of the bottle 12 joins the lower main body 14 and upper neck 20 together by tapering upwardly and inwardly from the lower main body to the upper neck. The interior space bound by the lower main body thus defines a main reservoir of the bottle for storing a volume of potable water therein, while the smaller-diameter upper neck defines a pour spout from which the water gravitationally drains when the bottle is inverted into an installed position on a water cooler. The present invention makes use of the water bottle and its contents as a weighted core for the baby stand-up training aid. The contents of the water bottle during its use in the context of the present invention may be a volume of potable water intended for later consumption from a water cooler, or may be an alternate ballast material added to the bottle after consumption of its potable water if the bottle is intended for ongoing dedicated use in the context of the present invention. In the latter scenario, the ballast may be water or other liquid, or granular material, e.g. sand.

The water bottle cover 10 features a flexible hollow shroud 24 particularly shaped and configured so that its internal shape closely conforms to the outer shape of the water bottle 12 when fitted thereover. The shroud 24 thus features an internally cylindrical lower section 26 of uniform internal diameter, an internally tapered intermediate section 27 of non-uniform internal diameter that reduces upwardly from the lower section 26, and an internally cylindrical upper section 29 that stands upright from the tapered intermediate section 27 and has a uniform internal diameter less than that of the larger cylindrical lower section 26. The internal diameters of the shroud's lower, intermediate and upper sections closely conform to the outer diameters of the bottle's lower main body, intermediate shoulder, and upper neck, respectively. The hollow shroud has a fabric construction, which may feature a resiliently stretchable fabric, in which case the internal dimensions of the shroud in its unstretched normal state may be intentionally undersized relative to the outer dimensions of a typical 5-gallon water cooler bottle to ensure a relatively tight, conforming fit to the exterior of the bottle when stretched thereover, despite minor subtle variations in water cooler bottles from different suppliers.

Figure 2:
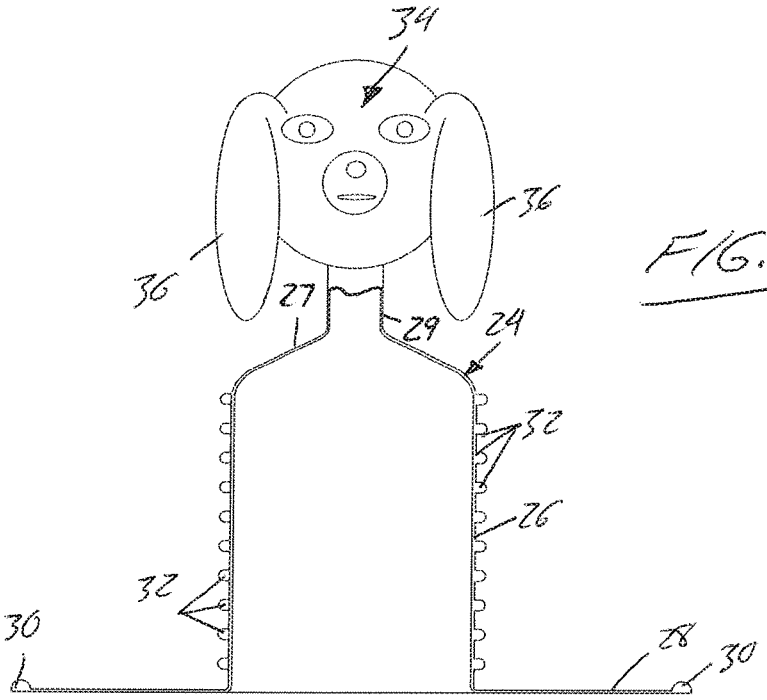
FIG. 2 is an elevational view of the water bottle cover of FIG. 1 partially sectioned in a central vertical plane.
Figure 3:
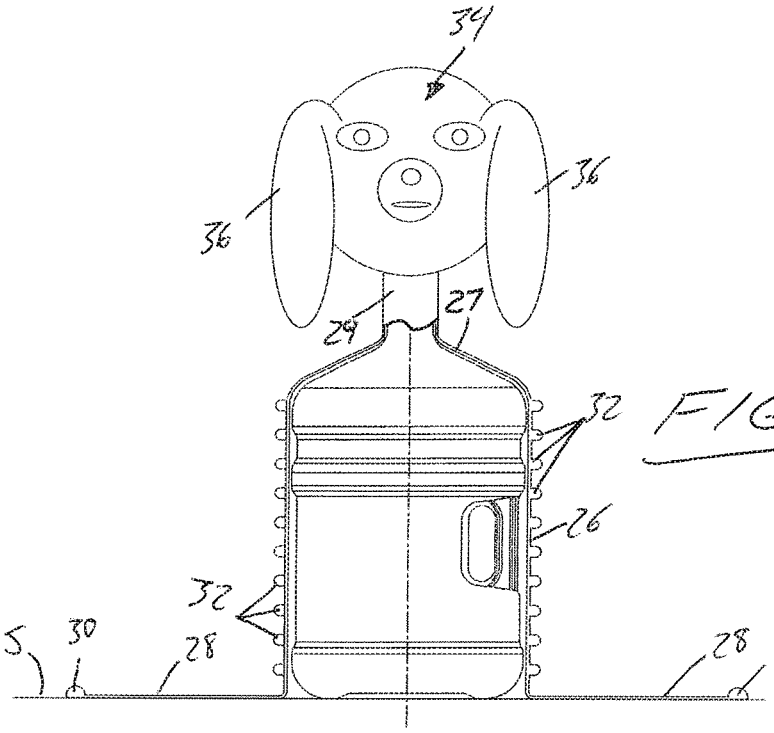
FIG. 3 is an elevational view of the partially sectioned water bottle cover of FIG. 2 when installed over the water cooler bottle of FIG. 1.

The bottom end of the shroud's lower section 26 is open to enable placement of the shroud over the water bottle 12. Attached to this bottom end of the shroud is an annular floor mat 28 extending radially outward from the shroud and spanning circumferentially around the entire outer perimeter thereof. Accordingly, with the water bottle 12 in an upright position with its base 18 seated on a ground or floor surface S, as shown in FIG. 1, lowering of the shroud 24 downwardly over the bottle 12 until the entire lower main body 14 of the bottle is encompassed within the lower section 26 of the shroud serves to place the floor mat 28 atop the ground/floor surface S in surrounding relation to the water bottle. As best shown in the cross-sectional views of FIGS. 2, 3 and 5, the floor mat 28 may feature a raised rim 30 spanning around the outer perimeter thereof, where the thickness of the floor mat 28 is greater than at the remainder thereof that spans outward from the bottom end of the shroud. Like the shroud, the mat is flexible, and may for example have a fabric construction sewn to that of the shroud, regardless of whether these two fabric components employ the same or different fabrics as one another. The shroud and/or mat may have a purely fabric construction formed solely of one or more layers of flexible fabric, or may incorporate additional padding or stuffing, for example housed in a closed envelope of such fabric. If padding or stuffing is included, it is preferably of sufficient flexibility to still allow folding or bunching of the fabric to enable the bottle cover 10 to be folded or bunched up into a compact form for packing, storage and transport. As an alternative to using padding or stuffing to minimize injury through floor impact in the event of a fall, the floor mat 28 may employ an inflatable construction.

The lower section 26 of the shroud 24 features a plurality of climbing elements 32 protruding outwardly therefrom on all four sides of its outer periphery at multiple elevations thereon, thus enabling a baby to use such elements climb up into a standing position on any of the four sides of the water bottle during use of the present invention. In the illustrated example, the climbing elements are a series of annular ribs or ridges each spanning a full circumference around the lower section 26 of the shroud at a respective elevation thereon, whereby at any point around the circumference of the bottle and shroud, the baby has something to grip at any of these elevations.

However, it will be appreciated that in other embodiments, each climbing element need be a full-circumference climbing element spanning continuously and fully around the shroud. As an alternative, smaller separate climbing elements may reside at discretely spaced-apart positions around the circumference of the shroud and bottle at various elevations thereof. In the full circumference example, each rib or ridge may be formed by a pleat-folded region of the fabric stuffed with a flexible filler. In embodiments with discrete climbing elements, they may be similarly formed by stuffed fabric pouches sewn to the shroud. In other examples, the climbing elements may simply be flexible fabric flaps or straps hanging from the exterior of the shroud, as opposed to a stuffed pleat or pouch. While loops may be employed as climbing elements, these may be less preferable other alternatives, to prevent the risk of a baby's arm or hand becoming caught in the loop, potentially resulting in injury should the child lose their balance and fall back to the ground from a full or partial standing position. In the instance of such a fall, the raised rim 30 at the outer perimeter of the floor mat 28 helps prevent or reduce the likelihood of the baby rolling off the floor mat 28. The climbing elements also need not have a fabric construction, and could for example be small plastic or rubber grips, affixed at discrete locations, whereby flexible fabric shroud can still be folded at unoccupied areas between the discretely mounted grips. Such grips may be of relatively rigid incompressible hardness, or may be resiliently compressible, at least at an outer layer thereof, to allow the baby's manual grip to dig deform the outer surface in a squeezing fashion.

Figure 4:
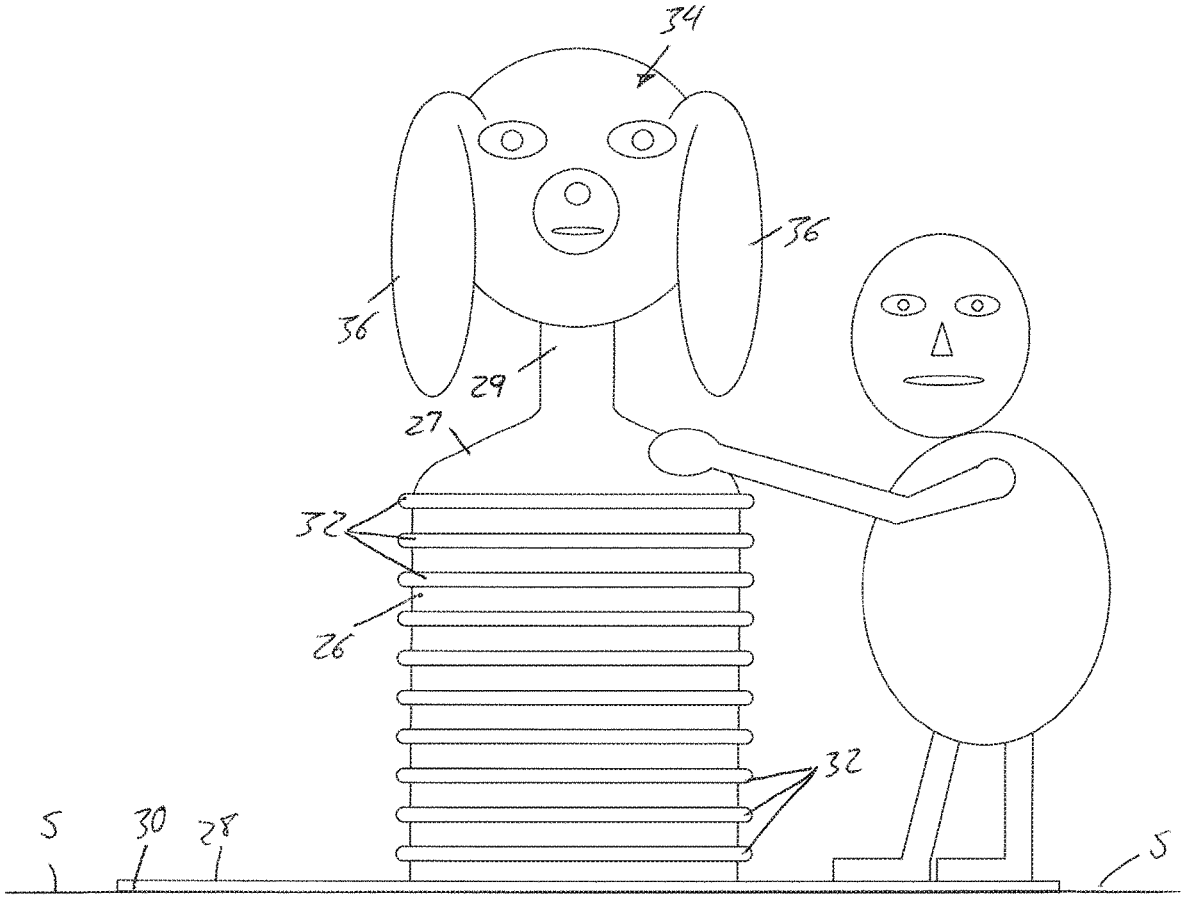
FIG. 4 is an elevational view of the water bottle cover and water cooler bottle of FIG. 3 during a baby's use of the stand-up training aid.

In use of the stand-up training aid, a baby crawls toward the bottle-encapsulating shroud 24, and in doing so travels onto the floor mat 28 that surrounds the shroud and encapsulated bottle. Once sufficiently close to the shroud, the baby can manually grasp the climbing elements 32, and use same to pull themself up into a full or partially erect standing position. The tapered shoulder of the water bottle, overlain with the tapered section of the shroud, forms an inclined surface on which the baby can place their hands once standing erect in order to help them balance in this standing position, as shown in FIG. 4.

The significant weight of a water-filled or other ballast-filled 5-gallon water cooler bottle serves to stabilize the stand-up aid, and hold it stationary when the climbing elements are being pulled on by the baby. Since many households use water coolers as their primary supply of drinking water, the present invention thus makes use of an existing heavily-weighted household object that most customers will already have in their possession. Accordingly, the manufacturer only need supply a compact, lightweight, and foldable or bunchable bottle cover to the consumer, who assembles the final apparatus by simply installing the cover over their existing water bottle. No bulky, heavy, structural assembly need be distributed to the customer, thus minimizing transport costs and retail shelving space. The customer also benefits from ease of setup, and optional compact storage of the folded/bunched bottle cover during times of non-use. Many households keep at least one water cooler bottle in reserve to replace the current bottle on the water cooler, and the present invention puts this reserve bottle to a useful purpose, rather than just taking up valuable storage space in the house.

To encourage the baby to initially approach the encapsulated water bottle, and subsequently climb up same upon arrival, the bottle cover can be equipped with any variety of ornamental and/or interactive elements for attracting and maintaining the attention of the baby, thus encouraging baby-initiated use of the apparatus, thereby accelerating the baby's development of gross motor skills.

In the illustrated example, an ornamental or decorative topper 34 is attached to the upper section 29 of the shroud 24 that surrounds the neck of the bottle, such that the decorative topper sits atop the bottle neck in the installed position of the bottle cover. As demonstrated by illustrated embodiment, the ornamental topper may incorporate a facial representation of a character or animal, though this is just one non-limiting example of an ornamental topper. While in the illustrated example, the shroud is of simple, thin, fabric construction with its outer shape thus generally conforming to that of the bottle, the shroud in other embodiments may incorporate padding or stuffing in a non-uniform manner imparting variation to the exterior shape of the shroud, for example to resemble the body of the animal or character whose facial likeness occupies the ornamental topper 34. In one example, the bottle cover may represent a snow man, with the lower section of the shroud having white, rounded exterior surfaces simulating two snowballs of a snowman's body, with the upper one such simulated body snowballs residing in close conformity over the shoulder of the water bottle. A third uppermost snowball would be embodied at the upper section 29 and ornamental topper 34 of the bottle cover to simulate the snowman's head, which may be equipped with a protruding carrot-shaped nose and/or pipe for optional gripping by the baby in a standing position capable of reaching such grippable ornamental elements.

Instead of the topper representing an animal or character, it may alternatively represent an object, for example a plant or food item. For example, the bottle cover may simulate a tree, with the shroud being shaped and coloured to represent the trunk of the tree, while the ornamental topper visually simulates a tree canopy with radiating branches or palm tree leaves. In another example, the bottle cover may simulate a pineapple, with the shroud being shaped and coloured to represent the skin of the fruit, while the ornamental topper visually simulates the leafy crown of the pineapple.

In the illustrated example, the facial representation includes low-hanging ears 36 reaching into close proximity to the shoulder of the water bottle to enable gripping and pulling of the low-hanging ears by the baby, for stabilization, balance or amusement purposes. Made of sufficiently light material, the hanging ears may also be free-swinging so as to sway or shift under the affect of air currents, whereby such movement helps draw attention of the baby toward the apparatus, and on arrival at the apparatus, draws their attention upwardly to encourage climbing. Downward-hanging leaves or branches in plant or food simulating embodiments may be used to similar effect, as may other downward hanging elements that aren't necessarily part of visual simulation of a character, animal or object. For example, fabric tags are known to be attractive playthings to babies, and thus may be incorporated on the low-hanging elements of the ornamental topper 34, or at other locations thereon low enough to be reached in the baby's standing position to serve as a tactile plaything.

The topper may include small mirrors or other shiny reflective articles to likewise draw and maintain the baby's attention, and may for example be applied to free-swinging elements like those described above to create further visual stimulation for attraction purposes as the light reflection varies with movement of the free-swinging elements. Interactive elements grippable by the baby, whether in the form of the hanging ears, branches, or leaves; protruding nose or pipe, or other hanging/protruding elements, may incorporate crinkle material (e.g. plastic film contained in a protective fabric envelope) to create an audible crinkle effect when gripped and crumpled by the baby. The topper may also incorporate electrically illuminable devices that switch between on and off states, optionally in a flashing pattern, to visually draw the baby's attention. The same devices, or other electrical devices additionally or alternatively incorporated into the decorative topper, may incorporate audio-playback functionality to play sound effects for audible attraction purposes.

In addition or alternative to their incorporation into the ornamental topper that resides above the bottle neck, any of the forgoing interactive elements (including shiny/reflective articles, illuminable devices, audio playback devices, tags, etc.) may be incorporated at the neck-surrounding upper section 29 and shoulder-covering tapered section 27 of the bottle cover 10, thus providing visual and/or tactile stimulation to the baby once they achieve a standing position with manual access to the tapered and upper sections of the bottle cover, as shown in FIG. 4. Particularly at the tapered section 27 of the shroud, the inclined surface of the underlying shoulder 22 of the bottle provides a supportive worksurface to underlie interactive elements that may be attached to the shroud, for example including such playthings as manipulatable buttons or switches, spinners, etc., some or all of which may incorporate lighting and/or sound effects. Accordingly, the baby's successful climb into a standing position is rewarded with access to interactive playthings at the tapered shoulder area, whereby the baby is encouraged to try and maintain the standing position, thus advancing their sense of balance to improve their gross motor skills, while also encouraging interaction with the manual playthings to help develop fine motor skills.

Other interactive elements optionally attached at one or both of the tapered and upper sections of the shroud may be used to provide oral stimulation, for example in the form of chewable tags or teething rings. Connection loops or clips for selective attachment of separate toys or accessories may also be provided at one or both of the tapered and upper sections of the shroud to enable parents to selectively attach toys or other existing attractants to which their baby already has an established affinity, thereby further encouraging baby-initiated use of the apparatus.

When the baby is climbing up the side of the bottle into a standing position, and while the standing baby is subsequently interacting with interactive elements on the shroud 24 and/or topper 34, the baby is standing atop the floor mat 28 of the bottle cover, whereby slippage of the bottle cover around the water bottle is prevented by the baby's own weight. The baby's weight exterior on the mat thus serves to anchor the bottle cover in place. Additional resistance to such slipping of the installed cover relative to the water bottle may be provided by placement of frictional grips of greater frictional coefficient than the constituent fabric of the shroud on the internal surface of the shroud, thus providing movement-resisting friction between the bottle and the shroud.

Figure 5:
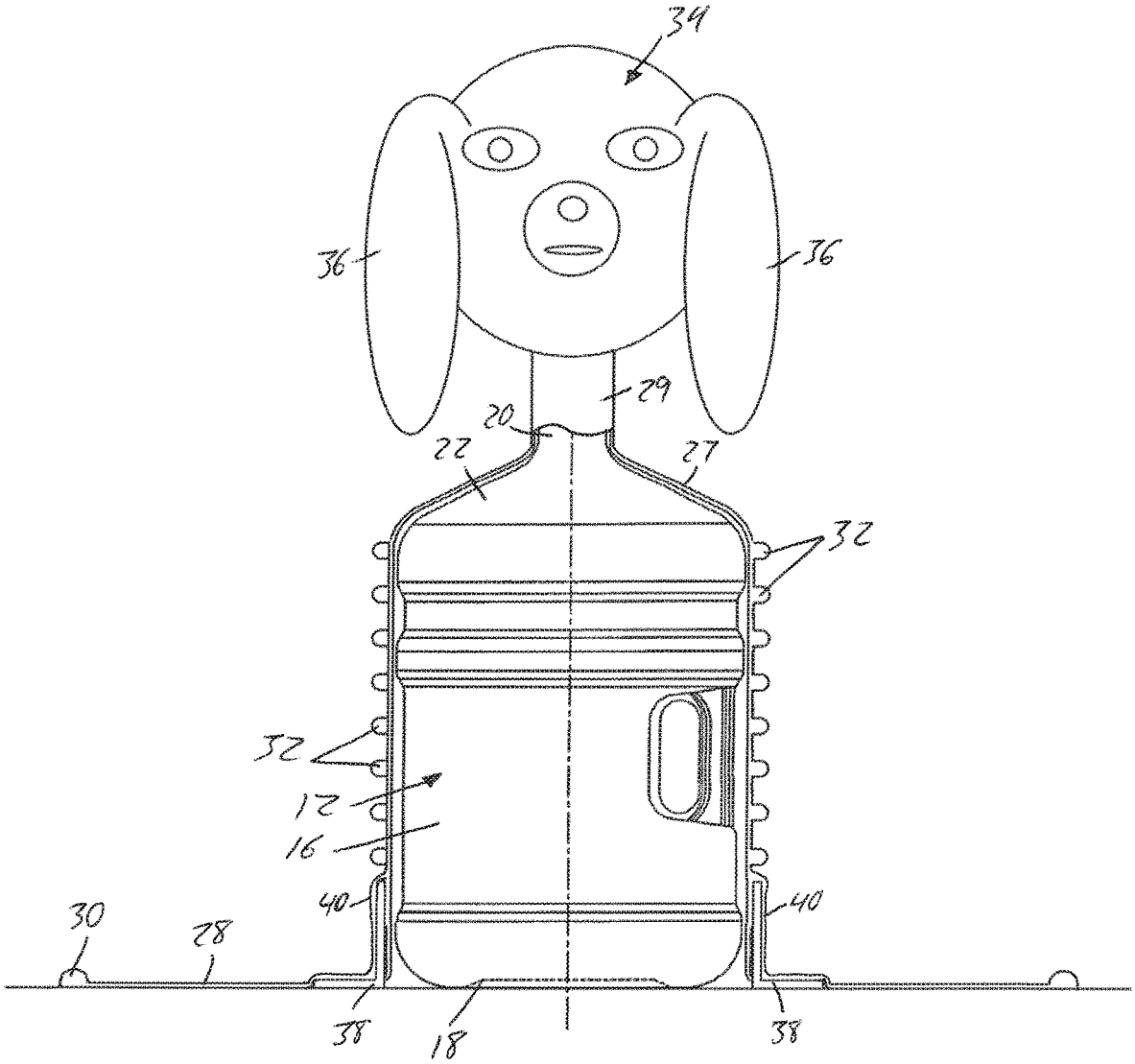
FIG. 5 illustrates incorporation of stabilization braces to baby the stand-up training aid to help stabilize the water cooler bottle and prevent tipping thereof.

In addition to such slippage protection provided by the baby's own weight via the floor mat to ensure the stability of the bottle cover relative to the bottle, further stabilization of the water bottle itself may be incorporated into the apparatus to augment the inherent stability provided by the bottle's ballast-filled weight. An example of this is shown in FIG. 5, where a set of L-shaped support braces 38 are provided for placement thereof at respective positions around the outer circumference of the bottle's lower main body 14, with one leg of each L-shaped brace lying horizontally in abutted relation with the floor/ground surface S, and the other standing vertically upright in adjacent relation the peripheral wall 16 of the bottle's lower main body 14. In the illustrated example, these braces 38 are maintained in such positional relation to the bottle 12 by the shroud 24 of the bottle cover 10. For such purpose, the lower section 26 of the shroud has a series of downwardly opening pockets or sleeves 40 therein at spaced positions around the bottom end of the shroud. Each such pocket 40 is accessed via an opening in the floor mat 28 where it joins to the shroud.

To install the braces, first the bottle cover is placed in the installed position over the ballast-filled water bottle seated on the floor/ground surface S. Moving around the bottle cover from pocket to pocket to install the braces respectively therein one-by-one, the floor mat is temporarily folded upward to reveal the opening therein at the bottom end of the respective pocket, though which one leg of the L-shaped brace is inserted into the pocket. The other leg is seated on the floor/ground surface S, and the floor mat 28 is laid back down to conceal this floor-lain leg of the brace thereunder. Alternatively, the braces 38 may be permanently incorporated into the bottle cover during manufacture, for example by encapsulating the braces into sewn-closed pockets, rather than requiring user-installation of the braces during setup of the apparatus with the water bottle at the user's home.

In another embodiment, instead of using the shroud to position the braces relative to the water bottle, an alternative technique may be used, for example by having an elastic or tightenable belt or strap onto which the braces are affixed at spaced positions. The user the belt or strap circumferentially around the bottle near the bottom of the lower main body to hold the braces in place against the peripheral wall 16 of the bottle. Preferably, though not necessarily, this belted or strapped installation of the braces is performed before subsequently installing the bottle cover, whereby the braces get covered by the floor mat of the subsequently installed bottle cover to in order protect the baby from contact with the braces. These are only select options by which auxiliary braces may be cooperatively installed on the bottle, and other techniques may alternatively be employed.

FIGS. 6 through 9 illustrate an alternate embodiment, which like that of the earlier figures again features a bottle-covering shroud 24', an accompanying floor mat 28', and a set of stabilization braces 38'. In this embodiment, the shroud 24' and floor mat 28' are separate components that are selectively attachable together for use, and selectively detachable from one another for folding and storage. The floor mat 28' is of arcuate-shape spanning slightly more than 360-degrees, whereby when laid out flat, it forms an annular shape spanning a full circumference around a central opening 42, with two ends 28A, 28B of the mat in slightly overlapped relation for releasable fastening together of these ends, for example via mating strips of hook and loop fastener 44 thereon. In the figures, the fastened strips of hook and loop fastener 44 are represented by broken line hatching, since the fastener 44 is hidden between the overlapping ends 28A, 28B of the mat 28'. It will be appreciated, other fastener types may alternatively be used for the same purpose of securing the two ends 28A, 28B of the arcuate mat 28 together in overlapping or adjacent relation to one another. In this fastened state, the mat spans a full 360-degree circumference around the central opening 42, through which the water cooler bottle 12 is seated on the floor or ground. When the fasteners 44 are decoupled, the two ends 28A, 28B of the mat 28' are disconnected, thus denoting an open break in the mat's annular span around the central opening 42, which can be selectively reclosed by re-coupling of the fasteners 44.

Figure 8:
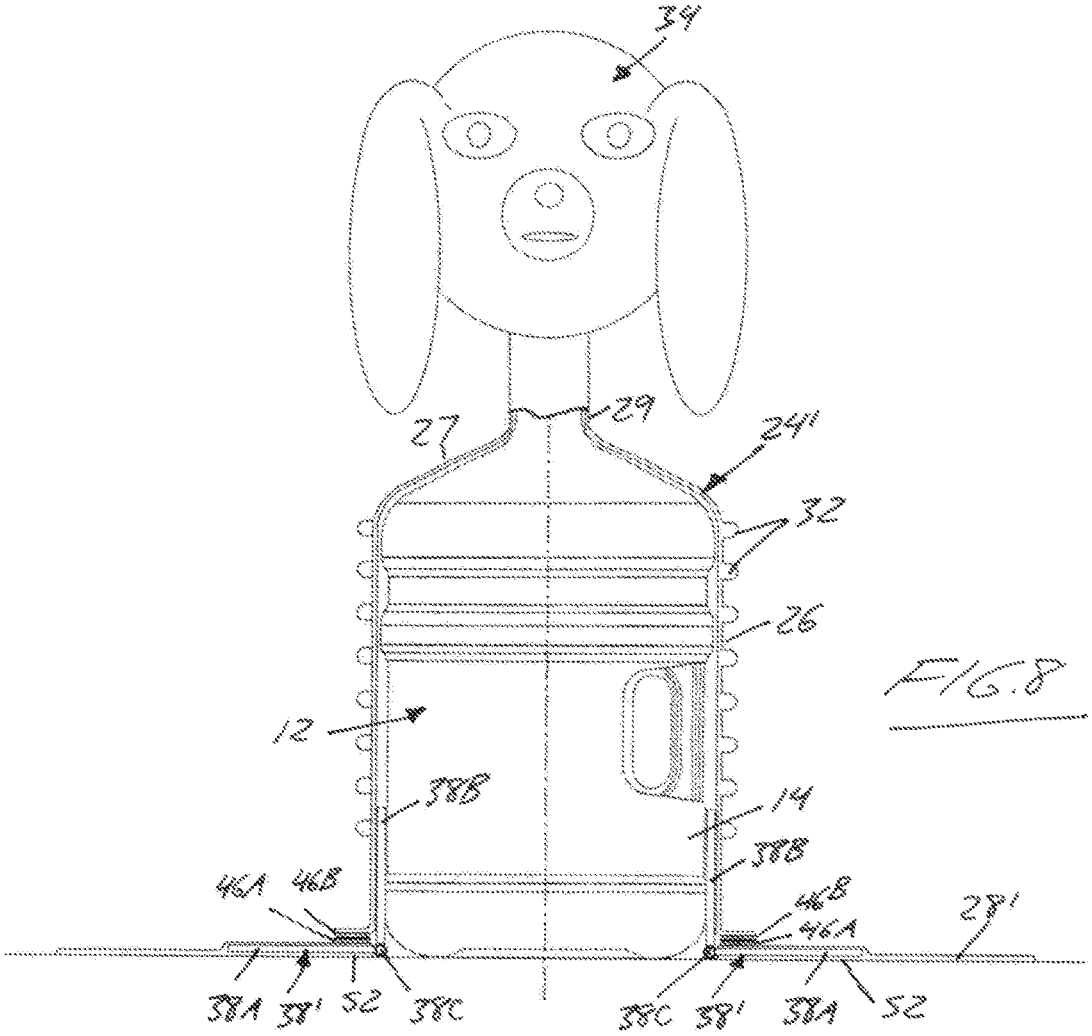
FIG. 8 is an elevational view of the entire second embodiment baby stand-up training aid in use on a water bottle, with a removable shroud attached to the unfolded mat and fitted over both the water cooler bottle and the unfolded stabilization braces.
Figure 9:
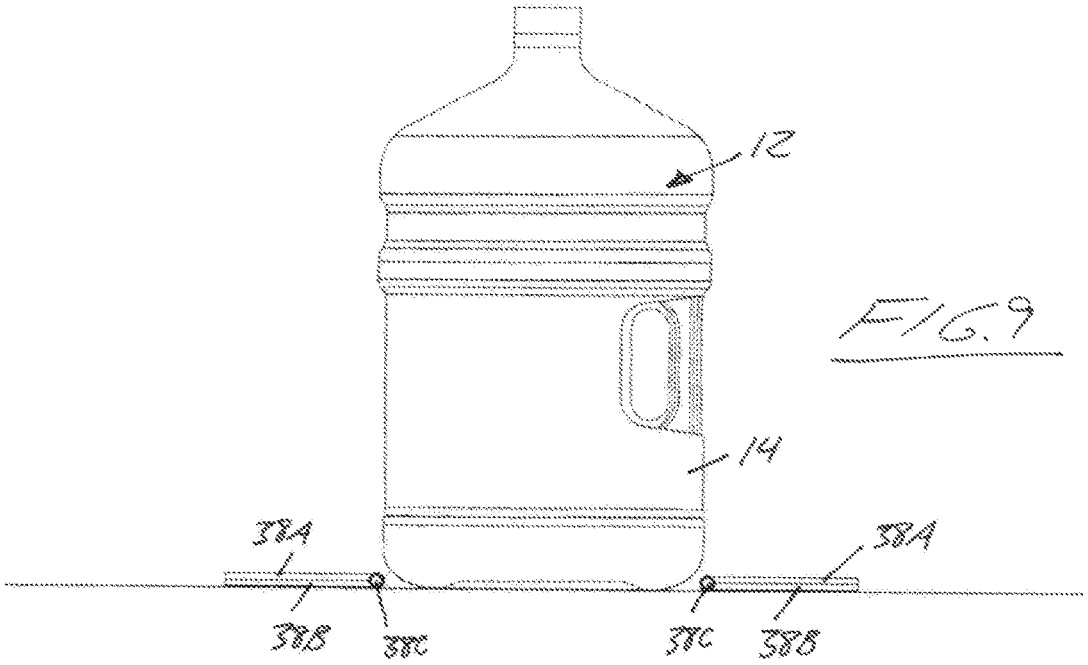
FIG. 9 is an elevational view of the water bottle and foldable stabilization braces of FIG. 8, but with the mat and shroud removed, and the stabilization braces folded up for compact storage.

Along an inner perimeter edge 28C of the laid out mat 28' that denotes the boundary of the central opening 42, the topside of the mat features a continuous strip or discrete pieces of hook or loop fastener 46A spanning or distributed around the central opening 42 for mating with a mating continuous strip or discrete pieces of hook or loop fastener 46B attached to the separate shroud 24' around the perimeter of a bottom opening therein, as shown in FIG. 8. By mating of these hook and loop fasteners 46A, 46B together around the central opening 42 of the mat 28' and the aligned bottom opening of the shroud 24', the shroud and mat are selectively attachable and detachable to and from one another. This allows cooperative use of the mat 28' and shroud 24' together with the water cooler bottle 12, but also separately folded storage of the two when not in use.

At generally equal angular intervals around the circumference of the central opening 42 at radial orientations relative thereto, the mat 28' in the illustrated example has a set of predefined fold lines 48 that divide the mat's annular shape into a plurality of segments 50A-50D of generally equal arcuate measure between its two ends 28A, 28B. The illustrated example features three separate fold lines 48 defining the mat into four roughly equal segments 50A-50D, though the quantity of fold lines (N) and resulting quantity of segments (N+1) may be varied from that shown. When the detachable shroud 28' is removed, and the mat's end-fasteners 44 are unfastened to disconnect the two ends 28A, 28B of the mat 28' from one another, the segments 50A-50D can be folded over one another, for example in accordion fashion, into a segment-shaped stack. This folded state of the mat 28' is shown in FIG. 7, from which it can bee seen that the footprint area of the folded stack is greatly reduced (by a factor of 1/N) compared to the unfolded state shown in FIG. 6.

Such segment-over-segment folding of the mat 28' may be performed by the user for storage purposes, regardless of whether there or not there are predefined fold lines for visually guiding this folding pattern. If included, the fold lines may be purely visual indicators, e.g. printed markings on the fabric of the mat, or may have a physical/tactile distinction from other areas of the mat. For example, each fold line may comprise a sewn seam, which optionally may be a pinched seam of reduced thickness relative to thicker padded areas between such seams, if the mat has a padded construction. In such instance, the pinched seam may lack the internal padding of, or have reduced padding relative to, the thicker padded areas to provide increased flexibility needed at these fold lines to fold the thicker padded areas into stacked positions flush atop one another.

Each segment of the mat 28', at an underside thereof that faces the floor or ground during use of the mat, has a respective sleeve or pocket 52 lying radially thereof, in which to receive a respective one of the foldable stabilization braces 38'. Each foldable brace 38' features a base leg 38A, and a bracing leg 38B pivotally hinged thereto. When in use to stabilize the water cooler bottle 12, as shown in FIG. 8, the base leg 38A is that which lays flat atop the ground or floor, and the bracing leg 38B is that which stands upright against or adjacent the peripheral wall of the bottle's main body 14. The hinged connection 38C between the legs 38A, 38B is configured to allow folding and unfolding of the two legs relative to one another over a 270-degree working range, the two extremes of which represent fully folded and unfolded states of the brace 38'. In the fully folded state, the two legs 38A, 38B are folded together into generally parallel and abutting, or closely adjacent, face-to-face relation to one another, thus flattening the brace 38' for compact storage and transport. On the other hand, in the fully unfolded state, the two legs 38A, 38B diverge at a generally perpendicular angle to one another. In their installed working positions of stabilizing relation to the water cooler bottle 12, the braces 38 have their base legs 38A concealed under the mat 28', within the sleeves or pockets 50 thereof if included, while the bracing legs 38B stand upright in the unfolded position at the central opening 42 of the mat 28' and within the confines of the attached shroud 24'. The base legs 38A are preferably removable from the sleeved or pocketed mat 28' to enable machine-safe washing of the mat alone.

The side of the bracing leg 38B that faces the water cooler bottle 12 is the side thereof facing the 270-working range of the hinge, whereby the bracing leg 38B cannot be tilted outwardly away from the water cooler bottle 12, and thus serves to stabilize the bottle. In other words, in the installed working position and unfolded state of the brace 38', an inner side of the bracing leg 38B that faces the base leg 38A in the folded state must be faced inwardly toward the bottle 12, while the inner side of the base leg 38A that faces the bracing leg 38B in the folded state must be faced downwardly toward the ground or floor. For safety, one or both bracing legs 38A, 38B may be visually marked to guide their proper placement in this manner, as improper placement would defeat the functionality of the stabilization brace. Alternatively, or additionally, each stabilization brace 38' may incorporate a locking mechanism that locks the stabilization brace in an unfolded position with the legs 38A, 38B diverging at ninety degrees, to prevent or reduce concerns over proper user-placement. For optimal safety, a self-locking mechanism may be employed that automatically engages when the brace 38' is unfolded, and can only be unlocked for re-folding and storage when a specific lock-release function is performed by the user. In embodiments with locking braces, a specific 270-degree working range of the hinge is unnecessary, and a 90-degree working range would optionally suffice.

Figure 6A:
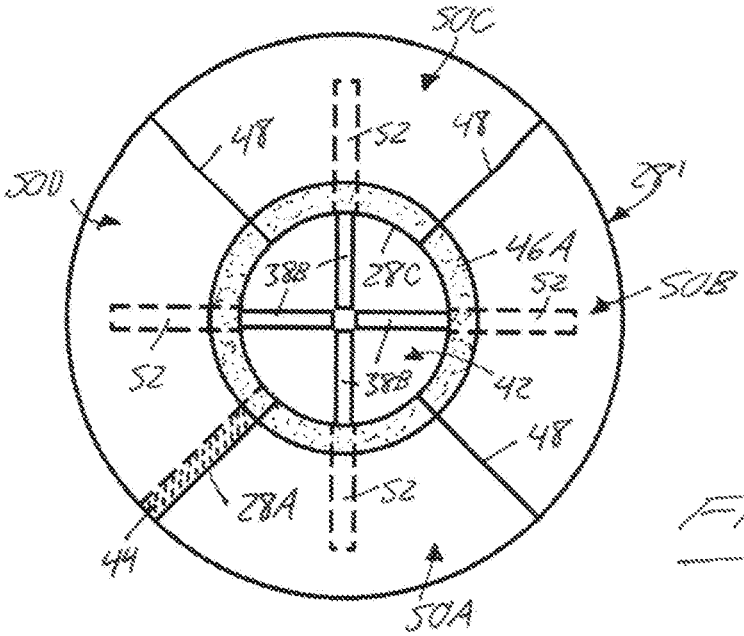
FIGS. 6A and 6B are top and bottom plan views of a foldable mat and cooperating foldable stabilization braces of a second embodiment baby stand-up training aid, with said mat in an unfolded state ready for use, and said stabilization braces in partially unfolded positions during preparation thereof for use.
Figure 6B:
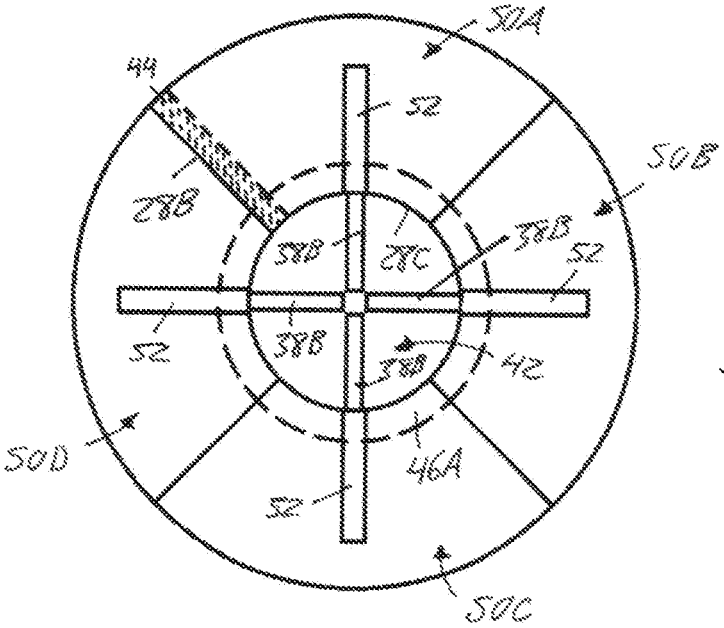
Figure 7:
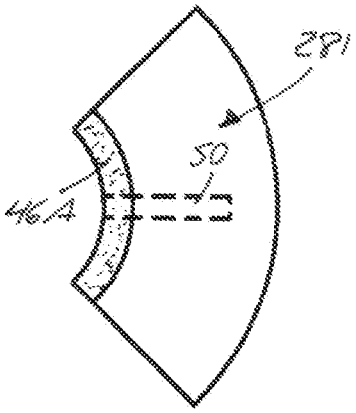
FIG. 7 is a top plan view of the removable and foldable mat of FIG. 6 in a folded storage position.

FIG. 6 represents an embodiment with a 270-degree working range of the stabilization braces 38', and shows the braces in an intermediate (i.e. partially unfolded) state where each bracing leg 38B has been unfolded to 180-degrees. Each bracing leg 38B thus lies in-line with the respective base leg 38A that has been inserted into a respective pocket or sleeve 50 of the mat. The bracing leg 38B is thus shown flat atop the ground or floor inside the central opening 42 of the mat 28', from which it needs to be fully unfolded into an upright position to accommodate placement of the water bottle between the upright bracing legs 38B. However, to make placement of the bottle 12 easier without fear of knocking down any of such erected bracing legs 38B, the bottle 12 may be placed on the ground before any placement of the braces 38', whether by placement of the bottle 12 on the floor or ground before subsequently laying out of the mat 28' around the bottle; or by placement of the bottle 12 on the floor or ground after having already laid out of the mat, in which case the bottle is placed in the central opening 42 of the laid out mat before the braces 38' are inserted under, or into the sleeves/pockets of, the mat 28'. Since various modifications can be made in my invention as herein above described, and many apparently widely different embodiments of same made, it is intended that all matter contained in the accompanying specification shall be interpreted as illustrative only and not in a limiting sense.

The invention claimed is:

1. For use by a baby during development of gross motor skills, a stand-up training aid useful in combination with a water cooler bottle having a lower main body of generally cylindrical shape, an upper neck of lesser diameter than said main lower body, and an intermediate shoulder section tapering upwardly and inwardly from said lower main body to said upper neck, said baby stand-up training aid comprising:

a bottle cover comprising:

a shroud sized and shaped to fit over said water cooler bottle in an installed position spanning circumferentially around the lower main body of the water cooler bottle, and in overlying relation to the intermediate shoulder section of the water cooler bottle around the upper neck thereof; and any one or more of the following:

a mat attached or attachable to the shroud at a lower end thereof and emanating outwardly therefrom in order surround the water cooler bottle in a lain position atop a ground or floor surface when the lower main body of the water cooler bottle is seated on said ground or floor surface;

a plurality climbing elements attached to an exterior of the shroud that faces outwardly away from the water cooler bottle in the installed position to enable manual gripping of said climbing elements by said baby, said climbing elements being distributed circumferentially around the shroud on all sides thereof and distributed at multiple elevations on said shroud on each of said sides thereof;

ornamental and/or interactive elements attached to the shroud at or proximate an upper end thereof to reside at or proximate an upper end of the water cooler bottle in the working position of the shroud to attract attention of the baby toward elevated locations on or above the water cooler bottle; and connection elements attached to the shroud at or proximate an upper end thereof to accept selective coupling of toys or accessories to the shroud to attract attention of the baby toward elevated locations on or above the water cooler bottle.

2. The stand-up training aid of claim 1 comprising said ornamental and/or interactive elements, and wherein said ornamental and/or interactive elements comprise at least one illuminable element operable between lit and unlit states.

3. The stand-up training aid of claim 1 wherein said illuminable element is a flashing illuminable element operable in a flashing mode switching between said lit and unlit states.

4. The stand-up training aid of claim 1 comprising said ornamental and/or interactive elements, and wherein said ornamental and/or interactive elements comprise at least one reflective element.

5. The stand-up training aid of claim 1 comprising said ornamental and/or interactive elements, and wherein said ornamental and/or interactive elements comprise at least one sound-effect element operable to emit audible sound.

6. The stand-up training aid of claim 1 comprising said ornamental and/or interactive elements, and wherein said ornamental and/or interactive elements comprise at least one flexible tag hanging outwardly from the shroud.

7. The stand-up training aid of claim 1 wherein said bottle cover visually simulates another object.

8. The stand-up training aid of claim 1 further comprising support braces connected or connectable to the shroud in positions operable to brace the lower main body of the water cooler bottle to resist tilting thereof.

9. The stand-up training aid of claim 8 wherein each support brace is movable between state a folded storage state which two legs of said support brace are folded together, and an unfolded working state in which said two legs diverge away from one another.

10. The stand-up training aid of claim 1 wherein the mat and shroud are configured for selective attachment and detachment to and from one another, and the mat is configured to occupy an annular shape spanning around a central opening in said lain position atop the ground or floor surface, and said mat comprises an openable/closeable break at which neighbouring or overlapping ends of the mat are equipped with matable fasteners for selective coupling and decoupling thereof to make and break said annular shape around the central opening.

11. The stand-up training aid of claim 10 wherein said mat comprises predefined fold-lines therein that separate said mat into distinct segments foldable over one another into a compact stack for storage.

12. The stand-up training aid of claim 1 in combination with said water cooler bottle.

13. The combination of claim 12 wherein the water cooler bottle cover is seated on a floor or ground surface, and the bottle cover resides in the installed position over the water cooler bottle.

14. A method of aiding development of a baby's gross motor skills, said method comprising adorning a ballast-filled water cooler bottle with the baby stand-up training aid of claim 1, and with said ballast-filled water cooler bottle seated on a ground or floor surface and covered by the bottle cover of said baby stand-up training aid of claim 1, using said ballast-filled water cooler bottle as a weighted object against which the baby can lean and climb into a standing position.

15. The method of claim 14 wherein said baby stand-up training aid comprises at least one of either said plurality of climbing elements and/or said ornamental and/or interactive elements.

16. The method of claim 15 wherein said baby stand-up training aid comprises said ornamental and/or interactive elements, and the method comprises supporting said ornamental and/or interactive elements on the water cooler bottle at or above an intermediate shoulder section thereof that tapers upwardly and inwardly from a lower main body of the water cooler bottle to an upper neck of said water cooler bottle.

17. The method of claim 14 wherein said bottle cover comprises a mat that emanates outwardly away from the water cooler bottle in a lain position atop the ground or floor surface on which the water cooler bottle rests.

18. The method of claim 17 comprising using a body weight of the baby atop said mat to resist movement of the bottle cover relative to the water cooler bottle.

19. The method of claim 14 comprising placing and securing one or more braces in adjacent relation to an outer perimeter of the water cooler bottle to resist tilting thereof.

* * * * *